US005898952A

United States Patent [19]

Hickey

[11] Patent Number: 5,898,952

[45] Date of Patent: May 4, 1999

[54] WATER HEATED TOILET SEAT

[76] Inventor: Matthew D. Hickey, 274 St. Helena St., Baltimore, Md. 21222

[21] Appl. No.: 08/921,445

[22] Filed: Aug. 29, 1997

[51] Int. Cl.[6] ..... A47K 13/30

[52] U.S. Cl. ..... 4/237; 4/DIG. 6

[58] Field of Search ..... 4/DIG. 6, 237

[56] References Cited

U.S. PATENT DOCUMENTS 802,106 10/1905 Matteson ..... 4/DIG. 6
929,079 7/1909 Cresse ..... 4/DIG. 6
1,839,156 12/1931 Lumpkin ..... 4/DIG. 6

*Primary Examiner*—Robert M. Fetsuga

[57] ABSTRACT

A heated toilet seat system is provided having a toilet with a bowl portion having an annular rim. Also included is a water heater having an input line for receiving water to be heated and an output line for delivering water that has been heated. Next provided is a toilet seat pivotally coupled to the toilet. The toilet seat further includes a tube situated within the toilet seat. Finally, an input conduit resides in communication with one of the ends of the tube of the toilet seat and the output line of the water heater for receiving hot water therefrom.

2 Claims, 3 Drawing Sheets

10
18
48
50
24
16
54
14

24
10
18

36
42
16
38
44
14

FIG 3
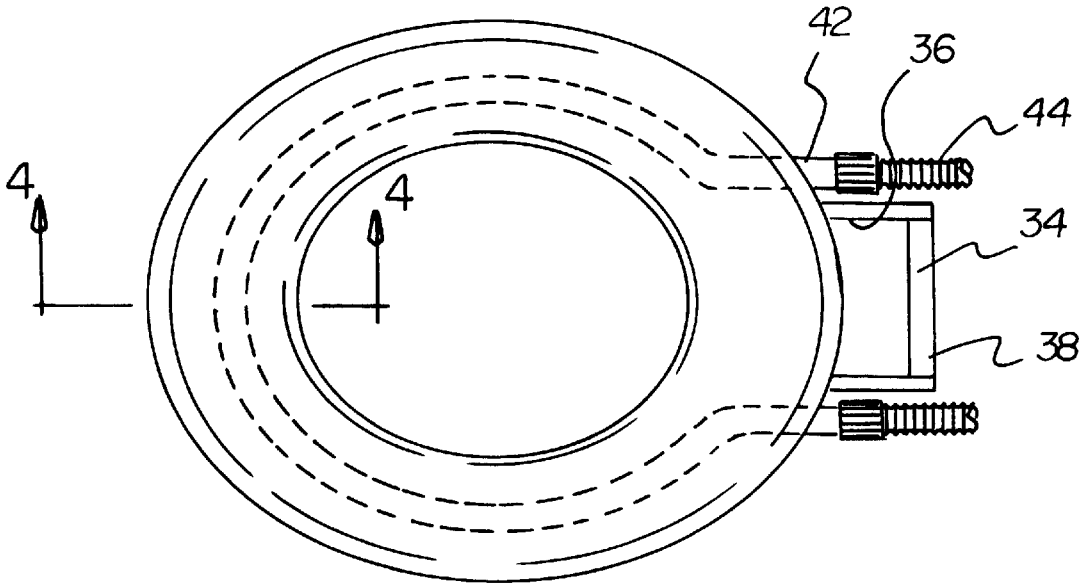
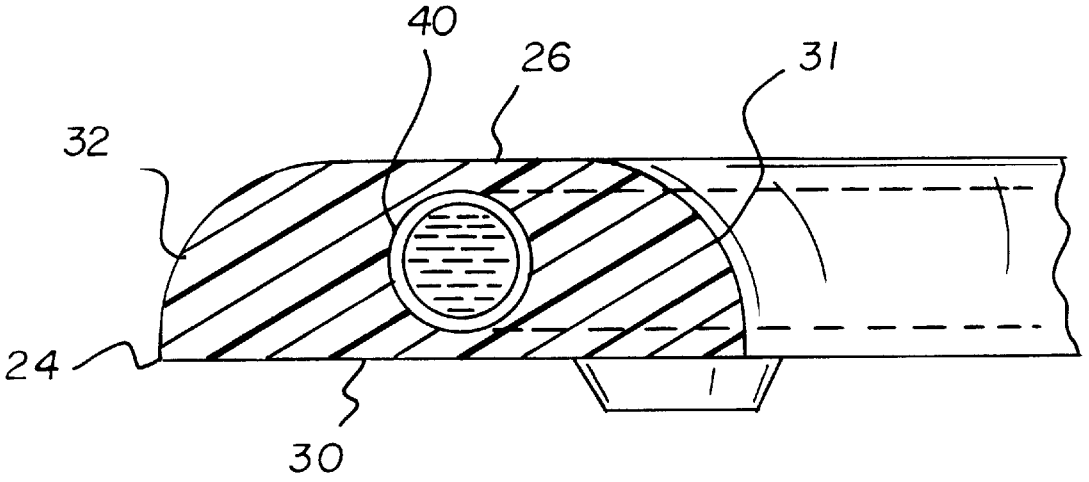
FIG 4

WATER HEATED TOILET SEAT

BACKGROUND OF THE INVENTION

1. Field of the Invention

The present invention relates to heated toilet seats and more particularly pertains to a new WATER HEATED TOILET SEAT for providing a safe means of heating a toilet seat.

2. Description of the Prior Art

The use of heated toilet seats is known in the prior art. More specifically, heated toilet seats heretofore devised and utilized are known to consist basically of familiar, expected and obvious structural configurations, notwithstanding the myriad of designs encompassed by the crowded prior art which have been developed for the fulfillment of countless objectives and requirements.

Known prior art heated toilet seats include U.S. Pat. No. 5,095,555; U.S. Pat. No. 4,446,584; U.S. Patent Des. 349, 760; U.S. Patent Des. 332,997; U.S. Patent Des. 322,850; and U.S. Pat. No. 3,968,344.

In these respects, the WATER HEATED TOILET SEAT according to the present invention substantially departs from the conventional concepts and designs of the prior art, and in so doing provides an apparatus primarily developed for the purpose of providing a safe means of heating a toilet seat.

SUMMARY OF THE INVENTION

In view of the foregoing disadvantages inherent in the known types of heated toilet seats now present in the prior art, the present invention provides a new WATER HEATED TOILET SEAT construction wherein the same can be utilized for providing a safe means of heating a toilet seat.

The general purpose of the present invention, which will be described subsequently in greater detail, is to provide a new WATER HEATED TOILET SEAT apparatus and method which has many of the advantages of the heated toilet seats mentioned heretofore and many novel features that result in a new WATER HEATED TOILET SEAT which is not anticipated, rendered obvious, suggested, or even implied by any of the prior art heated toilet seats, either alone or in any combination thereof.

To attain this, the present invention generally comprises a toilet with a bowl portion having an annular rim and a water assembly. The water assembly has a rectangular configuration situated at an inboard end of the annular rim and positioned thereabove. Next provided is a water heater having an input line for receiving water to be heated and an output line for delivering water that has been heated. As shown in FIGS. 3 & 4, a toilet seat is provided having an annular configuration with a planar top face, a planar bottom face and arcuate inner and outer edges formed therebetween. The toilet seat includes a bracket having a pair of spaced arms coupled to the bottom face thereof. A pivot is coupled to ends of the arms and the bowl portion of the toilet thereby allowing the toilet seat to pivot between a raised and lowered orientation. Note FIG. 2. The toilet seat further has an annular copper tube situated therein between a central extent of the top and bottom face thereof. The copper tube has a pair of spaced and parallel ends extending from the outer edge of the toilet seat adjacent an associated one of the arms of the bracket. Each end includes an exterior surface with a plurality of threaded grooves formed therein. A pair of plastic flexible tubes are included with a first end having a rotatable threaded couple adapted to engage the threaded grooves of the copper tube. A second end is positioned adjacent the water assembly of the toilet. Shown in FIG. 5 is an input conduit connected between the second end of one of the flexible tubes and the output line of the water heater for receiving hot water therefrom. Associated therewith is an output conduit connected between the second end of another one of the flexible tubes and the water heater. In use, the output conduit is adapted for allowing the reheating of water which flows through the copper tube. Finally, a push button valve is connected to the input conduit adjacent the flexible tubes. The push button valve has a first unbiased orientation for precluding hot water from flowing through copper tube. Further, the push button valve has a second biased orientation during the depression thereof. In such orientation, the hot water is allowed to flow through the copper tube for heating the seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new WATER HEATED TOILET SEAT apparatus and method which has many of the advantages of the heated toilet seats mentioned heretofore and many novel features that result in a new WATER HEATED TOILET SEAT which is not anticipated, rendered obvious, suggested, or even implied by any of the prior art heated toilet seats, either alone or in any combination thereof.

It is another object of the present invention to provide a new WATER HEATED TOILET SEAT which may be easily and efficiently manufactured and marketed.

It is a further object of the present invention to provide a new WATER HEATED TOILET SEAT which is of a durable and reliable construction.

An even further object of the present invention is to provide a new WATER HEATED TOILET SEAT which is susceptible of a low cost of manufacture with regard to both materials and labor, and which accordingly is then susceptible of low prices of sale to the consuming public, thereby making such WATER HEATED TOILET SEAT economically available to the buying public.

Still yet another object of the present invention is to provide a new WATER HEATED TOILET SEAT which provides in the apparatuses and methods of the prior art some of the advantages thereof, while simultaneously overcoming some of the disadvantages normally associated therewith.

Still another object of the present invention is to provide a new WATER HEATED TOILET SEAT for providing a safe means of heating a toilet seat.

Even still another object of the present invention is to provide a new WATER HEATED TOILET SEAT that includes a toilet with a bowl portion having an annular rim. Also included is a water heater having an input line for receiving water to be heated and an output line for delivering water that has been heated. Next provided is a toilet seat pivotally coupled to the toilet. The toilet seat further includes a tube situated within the toilet seat. Finally, an input conduit resides in communication with one of the ends of the tube of the toilet seat and the output line of the water heater for receiving hot water therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top view of the present invention.

FIG. 4 is a cross-sectional view of the toilet seat of the present invention taken along line 4—4 shown in FIG. 3.

DESCRIPTION OF THE PREFERRED EMBODIMENT

Figure 1:
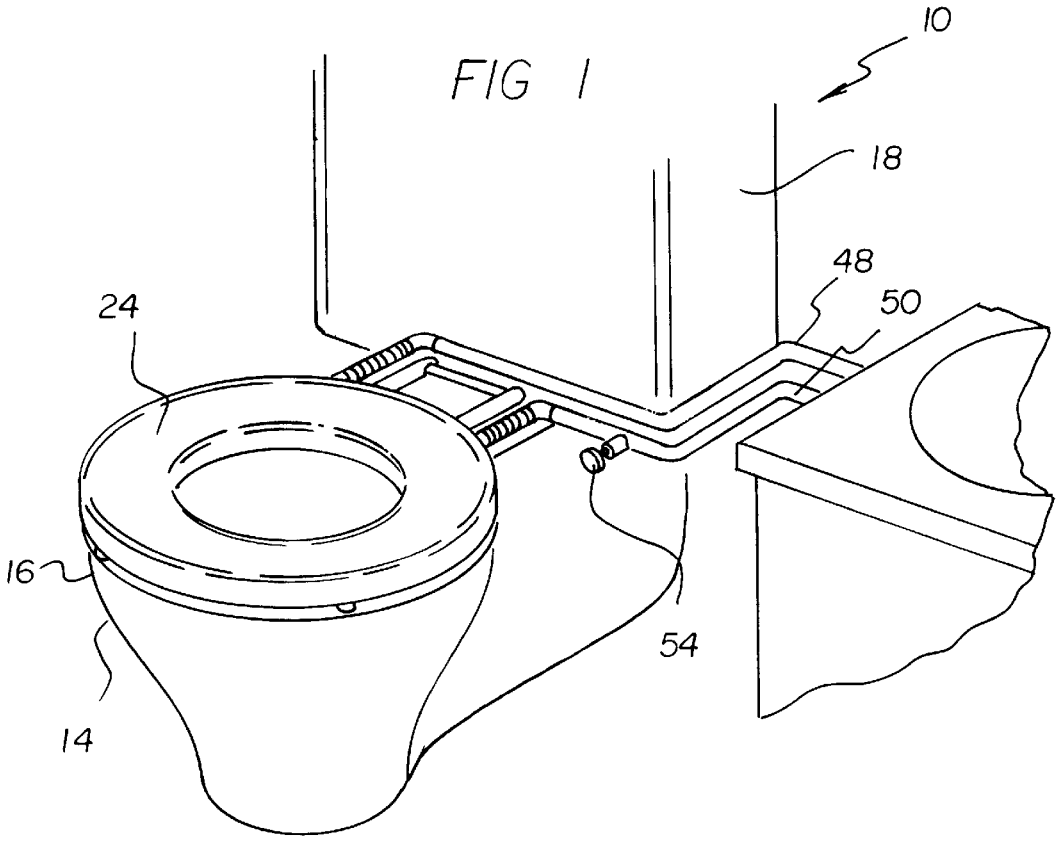
FIG. 1 is a perspective view of a new WATER HEATED TOILET SEAT according to the present invention.
Figure 2:
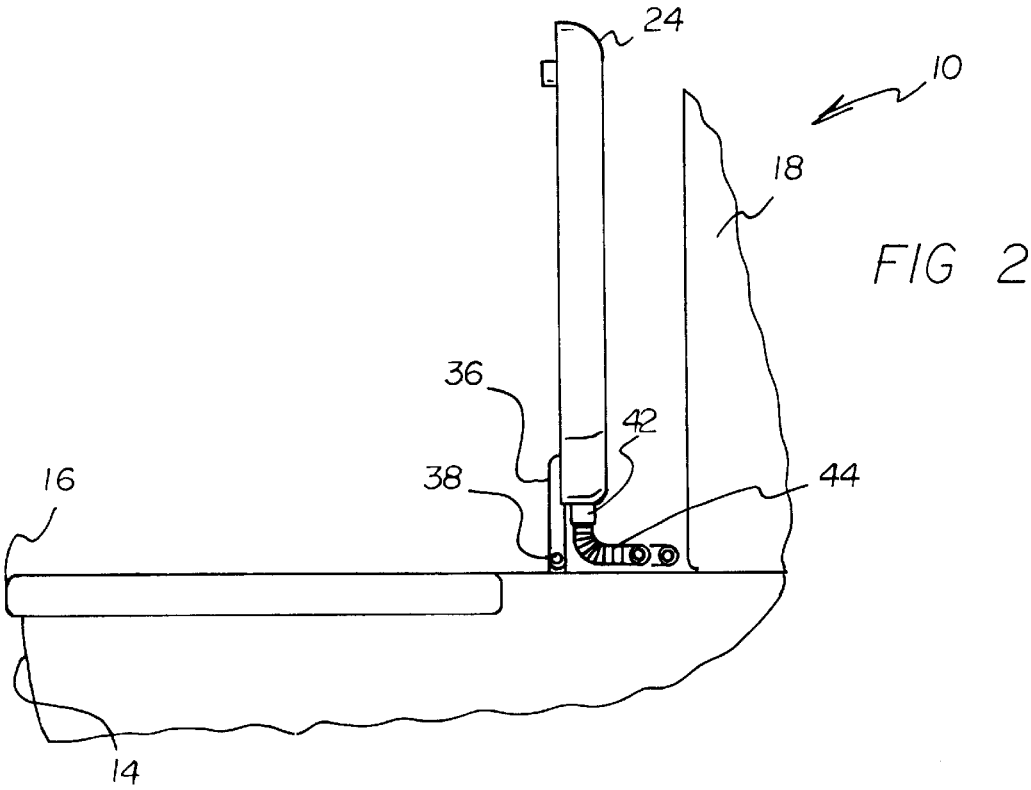
FIG. 2 is a side view of the present invention.
Figure 5:
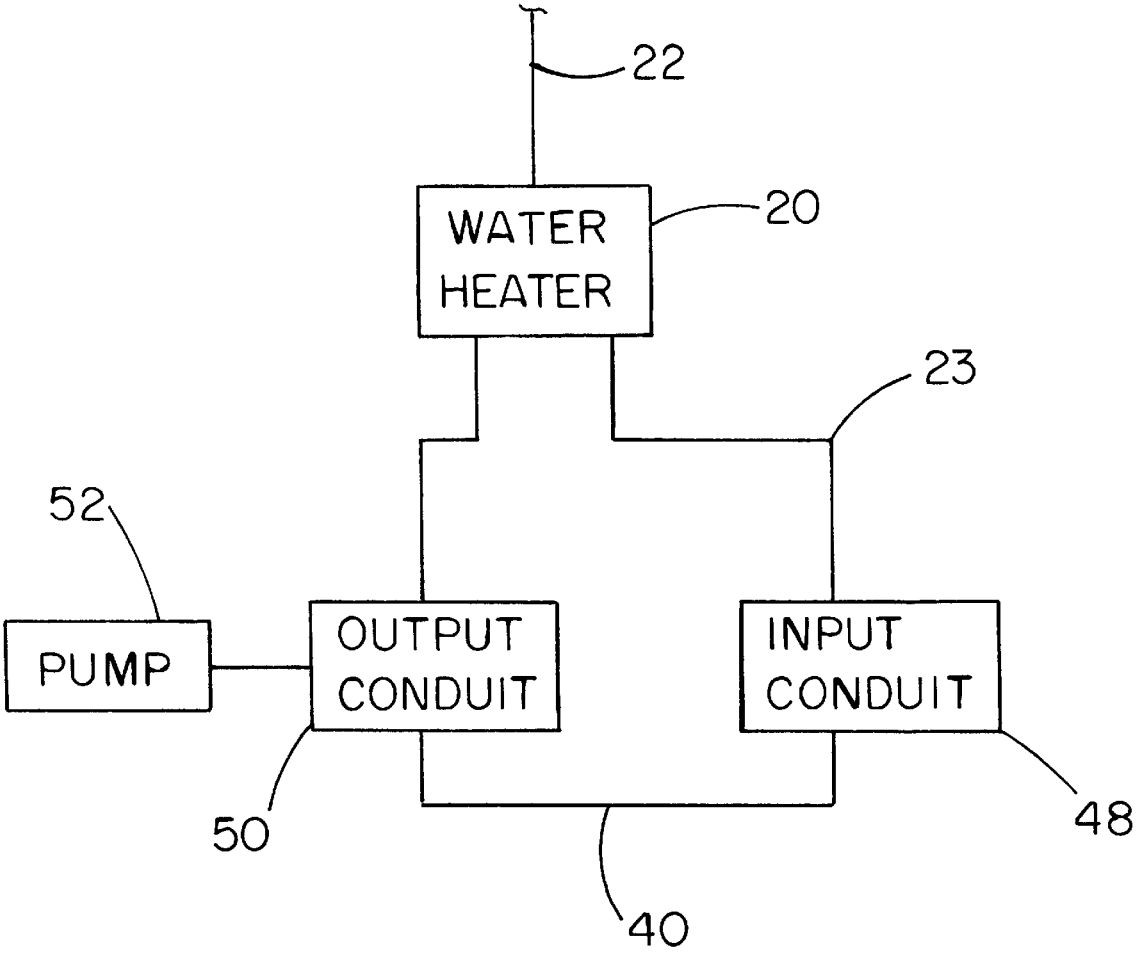
FIG. 5 is a general schematic of the interconnection of the various components of the present invention including the water heater.

With reference now to the drawings, and in particular to FIGS. 1 through 5 thereof, a new WATER HEATED TOILET SEAT embodying the principles and concepts of the present invention and generally designated by the reference numeral 10 will be described.

As shown in FIG. 1, there is shown a toilet 12 with a bowl portion 14 having an annular rim 16 and a water assembly 18. The water assembly has a rectangular configuration situated at an inboard end of the annular rim and positioned thereabove.

Next provided is a water heater 20 having an input line 22 for receiving water to be heated and an output line 23 for delivering water that has been heated. Preferably, the water heater is conventional in nature and is the central water heating mechanism for an entire building.

As shown in FIGS. 3 & 4, a toilet seat 24 is provided having an annular configuration with a planar top face 26, a planar bottom face 30 and arcuate inner edges 31 and outer edges 32 formed therebetween. The toilet seat includes a bracket 34 having a pair of spaced arms 36 coupled to the bottom face thereof. A pivot 38 is coupled to ends of the arms and the bowl portion of the toilet thereby allowing the toilet seat to pivot between a raised and lowered orientation. Note FIG. 2.

The toilet seat further has an annular copper tube 40 situated therein between a central extent of the top and bottom face thereof. Ideally, the periphery of the tube is spaced no more than ⅛ the thickness of the seat from the top face thereof. The copper tube has a pair of spaced and parallel ends 42 each extending from the outer edge of the toilet seat adjacent an associated one of the arms of the bracket. Each end includes an exterior surface with a plurality of threaded grooves formed therein.

A pair of plastic flexible tubes 44 are included each with a first end having a rotatable threaded couple adapted to engage the threaded grooves of the copper tube. Such threaded couples have an interior surface with threaded grooves formed therein. A second end is positioned adjacent the water assembly of the toilet. As shown in the Figures, the flexible tubes are bellowed for providing proper flexibility when the seat is raised and lowered.

It should be noted that in an alternate embodiment, the rim portion of the toilet is equipped with a pair of coupling apertures that are in communication with bores formed in the arms of the toilet seat via the pivot. The threaded apertures are, in turn, in communication with tubes which run within the toilet to the rear thereof whereat ends thereof have threaded grooves situated therein. As such, in the alternate embodiment, the coupling between the toilet seat and the toilet also functions as a conduit for fluid thereby obviating the need for the flexible tubes.

An input conduit 48 connected between the second end of one of the flexible tubes and the output line of the water heater for receiving hot water therefrom. Associated therewith is an output conduit 50 connected between the second end of another one of the flexible tubes and the water heater. As shown in FIG. 1, the input and output conduits are discreetly formed about a lower periphery of the water assembly of the toilet. In use, the output conduit is adapted for allowing the reheating of water which flows through the copper tube. As an option, an in-line pump 52 may be retrofitted to the output conduit for effecting the flow of water if necessary. Note FIG. 5.

Finally, a push button valve 54 is connected to the input conduit adjacent the flexible tubes. Ideally, the valve is positioned below the water assembly of the toilet and facing toward the rim portion thereof. The push button valve has a first unbiased orientation for precluding hot water from flowing through copper tube. Further, the push button valve has a second biased orientation during the depression thereof. In such orientation, the hot water is allowed to flow through the copper tube for heating the seat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water heated toilet seat system comprising, in combination:

a toilet with a bowl portion having an annular rim and a water assembly having a rectangular configuration situated at an inboard end of the annular rim and positioned thereabove;

a central water heater having an input line for receiving water to be heated and an output line for delivering water that has been heated;

a toilet seat having an annular configuration with a planar top face, a planar bottom face and arcuate inner and outer edges formed therebetween, the toilet seat including a bracket having a pair of spaced arms coupled to the bottom face thereof and a pivot coupled to ends of the arms and the bowl portion of the toilet thereby allowing the toilet seat to pivot between a raised and lowered orientation, the toilet seat further including an annular copper tube situated within the toilet seat between a central extent of the top and bottom face thereof, the copper tube having a pair of spaced and parallel ends extending from the outer edge of the toilet seat adjacent an associated one of the arms of the bracket, each end having an exterior surface with a plurality of threaded grooves formed therein;

a pair of plastic bellowed flexible tubes with a first end having a rotatable threaded couple with threaded grooves adapted to engage the threaded grooves of the copper tube and a second end positioned adjacent the water assembly of the toilet;

an input conduit connected between the second end of one of the flexible tubes and the output line of the water heater for receiving hot water therefrom, wherein the input conduit is positioned about a lower periphery of the water assembly of the toilet;

an output conduit connected between the second end of another one of the flexible tubes and the water heater for allowing the reheating of water which flows through the copper tube, wherein the output conduit is positioned about the lower periphery of the water assembly of the toilet; and a push button valve connected to the input conduit adjacent the flexible tubes with the push button valve being positioned below the water assembly of the toilet and facing toward a rim thereof, the push button valve having a first unbiased orientation for precluding hot water from flowing through copper tube and a second biased orientation during the depression thereof wherein the hot water is allowed to flow through the copper tube for heating the seat.

2. A water heated toilet seat system as set forth in claim 1 wherein a periphery of the tube is spaced no more than ⅛ the thickness of the seat from the top face thereof.

* * * * *